US008788252B2

(12) United States Patent
Zhou et al.

(10) Patent No.: US 8,788,252 B2
(45) Date of Patent: Jul. 22, 2014

(54) MULTI-WELL TIME-LAPSE NODAL ANALYSIS OF TRANSIENT PRODUCTION SYSTEMS

(75) Inventors: Wentao Zhou, Abingdon (GB); Raj Banerjee, Houston, TX (US); Eduardo Proano, Houston, TX (US); Ji Li, Beijing (CN); Yinli Wang, Beijing (CN); Peng Fang, Beijing (CN); Nelson Bolanos, Abu Dhabi (AE); R. K. Michael Thambynayagam, Sugar Land, TX (US); Gregory P. Grove, Houston, TX (US); Jeffrey B. Spath, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 298 days.

(21) Appl. No.: 13/281,152

(22) Filed: Oct. 25, 2011

(65) Prior Publication Data

US 2012/0101787 A1 Apr. 26, 2012

Related U.S. Application Data

(60) Provisional application No. 61/406,844, filed on Oct. 26, 2010.

(51) Int. Cl.
*G06G 7/48* (2006.01)

(52) U.S. Cl.
USPC ..... 703/10

(58) Field of Classification Search
USPC ..... 703/1, 2, 8, 10; 702/13; 73/152.31; 166/250.15, 250.07, 280.1; 324/346; 405/65; 367/73
See application file for complete search history.

(56) References Cited

U.S. PATENT DOCUMENTS

| | | | | |
|---|---|---|---|---|
| 3,724,662 | A * | 4/1973 | Ortiz | 405/65 |
| 4,442,710 | A * | 4/1984 | Meng | 73/152.31 |
| 4,443,762 | A * | 4/1984 | Kuckes | 324/346 |
| 6,101,447 | A * | 8/2000 | Poe, Jr. | 702/13 |
| 7,172,020 | B2 * | 2/2007 | Tseytlin | 166/250.07 |
| 7,369,979 | B1 * | 5/2008 | Spivey | 703/8 |
| 7,953,585 | B2 * | 5/2011 | Gurpinar et al. | 703/10 |
| 2006/0069511 | A1 | 3/2006 | Thambynayagam et al. | |
| 2007/0102155 | A1 * | 5/2007 | Chan et al. | 166/280.1 |
| 2007/0112547 | A1 * | 5/2007 | Ghorayeb et al. | 703/10 |
| 2008/0133194 | A1 * | 6/2008 | Klumpen et al. | 703/10 |

(Continued)

OTHER PUBLICATIONS

Busswell, G. et al, "Generalized Analytical Solution for Reservoir Problems with Multiple Wells and Boundary Conditions", SPE 99288, presented at the 2006 SPE Intelligent Energy Conference and Exibition held in Amsterdam, The Netherlands, Apr. 11-13, 2006, pp. 1-21.

(Continued)

*Primary Examiner* — Kandasamy Thangavelu

(57) ABSTRACT

A method, apparatus and program product utilize an analytical reservoir simulator to perform inflow simulation for a node during nodal analysis in a multi-well petroleum production system. By doing so, time-lapse nodal analysis may be performed of a transient production system in a multi-well context, often taking into account production history and the transient behavior of a reservoir system. Moreover, in some instances, an interference effect from different wells in a multi-well production system may be considered, and in some instances nodal analysis may be performed simultaneously for multiple wells. Multi-layer nodal analysis may also be performed in some instances to account for the pressure loss in a wellbore between multiple layers.

22 Claims, 10 Drawing Sheets

(56) References Cited

U.S. PATENT DOCUMENTS

| | | | | |
|---|---|---|---|---|
| 2008/0294387 | A1* | 11/2008 | Anderson et al. | 703/1 |
| 2009/0084545 | A1* | 4/2009 | Banerjee et al. | 166/250.15 |
| 2010/0125443 | A1* | 5/2010 | Abasov et al. | 703/22 |
| 2010/0142323 | A1* | 6/2010 | Chu et al. | 367/73 |
| 2010/0174517 | A1* | 7/2010 | Slupphaug et al. | 703/10 |
| 2010/0250215 | A1* | 9/2010 | Kennon et al. | 703/10 |
| 2011/0040536 | A1* | 2/2011 | Levitan | 703/2 |

OTHER PUBLICATIONS

Fetkovich, M. J., "The Isochronal Testing of Oil Wells", SPE 4529, prepared for the 48th Annual Fall Meeting of the Society of Petroleum Engineers of AIME, held in Las Vegas, NV, Sep. 30-Oct. 3, 1973, pp. 1-24.

Gilchrist, J. Phillip et al, "Semi-Analytical Solution for Multiple Layer Reservoir Problems with Multiple Vertical, Horizontal, Deviated and Fractured Wells", IPTC 11718, presented at the International Petroleum Technology Conference held in Dubai, U.A.E., Dec. 4-6, 2007, pp. 1-10.

Meng, H. Z. et al, "Coupling of Production Forecasting, Fracture Geometry Requirements and Treatment Scheduling in Optimum Hydraulic Fracture Design", SPE 16435, presented at the SPE/DOE Low Permeability Reservoirs Symposium held in Denver, CO, May 18-19, 1987, pp. 485-501.

Meng, H. Z. et al, "Production Systems Analysis of Vertically Fractured Wells", SPE/DOE 10842, presented at the SPE/DOE Unconventional Gas Recovery Symposium of the Society of Petroleum Engineers held in Pittsburgh, PA, May 16-18, 1982, 21 pages.

Vogel, J. V., "Inflow Performance Relationships for Solution-Gas Drive Wells", Journal of Petroleum Technology, Jan. 1968, pp. 83-92.

* cited by examiner

MULTI-WELL TIME-LAPSE NODAL ANALYSIS OF TRANSIENT PRODUCTION SYSTEMS

FIELD OF THE INVENTION

This application claims benefit of U.S. Provisional Application Ser. No. 61/406,844 filed by Wentao Zhou et al. on Oct. 26, 2010, and entitled "METHOD, SYSTEM, APPARATUS AND COMPUTER READABLE MEDIUM FOR MULTI-WELL TIME-LAPSE NODAL ANALYSIS OF TRANSIENT PRODUCTION SYSTEMS," which application is incorporated by reference in its entirety.

FIELD OF THE INVENTION

The invention is generally related to computers and computer software, and in particular, to computer evaluation of the production performance of transient production systems for petroleum reserves.

BACKGROUND OF THE INVENTION

Nodal analysis has been used in the petroleum industry to analyze the performance of production systems composed of interacting components. Conventional nodal analysis typically involves selecting a division point and dividing the system at this point. All of the components upstream of the node are referred to as inflow, while those downstream are referred to as outflow. Flow relationships of inflow and outflow are then solved using their respective computation methods, the results of which are usually termed inflow performance relationship (IPR) and outflow performance relationship, both as functions of flowing pressure and rate. The intersection of these two curves gives the nodal solution.

Conventional nodal analysis, however, has been found to lack accuracy. Traditional IPR using Darcy's flow equation assumes a stationary state of the inflow system, that is, constant reservoir pressure. The depletion of a reservoir, when it should be the result of nodal analysis, is merely modeled by the change of reservoir pressure as an input known a priori. The concept of transient IPR was developed to overcome the inadequacy of traditional IPR through the introduction of time as a variable in the model, typically using well test solutions. IPR models have been developed, for example, for radial flow and fracture flow, and by so doing, transient behavior of the inflow system may be modeled. However, it has been found that transient IPR, as a function of reservoir/well parameters and time only, often falls short of acknowledging the production history. Transient IPR is limited to a single time slice, or snap shot, of the whole production life and may assume a pseudo-steady-state. Production history is either excluded altogether from the model or addressed just from a material balance perspective.

In addition, traditional IPR models that are used widely might only be valid if the real reservoir/well model is as simple as assumed. Nodal analysis is generally performed on a well-by-well basis, and in some cases, no interference effect of neighboring well production is considered, not to mention conducting a nodal analysis simultaneously for multiple wells.

For other applications, reservoir simulation has traditionally been used by reservoir engineers to match history and predict performance of underground reservoir systems having multiple wells. However, it has been found that in practice, it takes considerable time and effort to construct reservoir models, and such reservoir models have not been thought to be well suited for use in nodal analysis associated with production operations, particularly due to their reliance on numerical reservoir simulation.

Therefore, a continuing need exists in the art for improved nodal analysis techniques for use in analyzing the performance of nodes in petroleum production systems.

SUMMARY OF THE INVENTION

The invention addresses these and other problems associated with the prior art by providing a method, apparatus, and program product that utilize an analytical reservoir simulator to perform inflow simulation for a node in a multi-well petroleum production system. By doing so, embodiments consistent with the invention may be able to perform time-lapse nodal analysis of a transient production system in a multi-well context, often taking into account production history and the transient behavior of a reservoir system. Moreover, in some embodiments, an interference effect from different wells in a multi-well production system may be considered, and in some instances nodal analysis may be performed simultaneously for multiple wells. In still other embodiments, multi-layer nodal analysis may be performed to account for the pressure loss in a wellbore between multiple layers.

Therefore, consistent with one aspect of the invention, nodal analysis for a multi-well petroleum production system is performed by, for a node in the petroleum production system, performing reservoir simulation for a reservoir associated with the node to simulate inflow for the node using a computer-implemented analytical reservoir simulator, and determining an operating point for the node based upon the reservoir simulation.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

DETAILED DESCRIPTION

Embodiments consistent with the invention typically provide time-lapse nodal analysis of transient production systems in a multi-well context, typically using a high-speed semi-analytical reservoir simulator and a pipeline simulator. The use of an analytical reservoir simulator, in particular, may enable more accurate and reliable modeling of the real inflow system, thereby leading to more accurate nodal analysis overall. As a consequence, embodiments consistent with the invention may have extensive modeling capabilities, partial penetration, arbitrary well trajectory, horizontal well, fractured well, multi-layer, etc.

In addition, in some embodiments of the invention, the dynamic evolution of nodal performance may be studied and all production history may be taken into account, a concept referred to herein as time-lapse nodal analysis. Moreover, in some embodiments, the transient behavior of the reservoir system may be studied, which may otherwise not possible with only a material balance model. The transient flow may be, for example, the radial flow at an early time for an oil reservoir, or the whole production time period for a shale-gas reservoir. Also in some embodiments, the interference effect from well to well may be considered, and in some instances, nodal analysis may be done simultaneously for multiple wells. In still other embodiments, when there is commingled production from multiple layers, multi-layer analysis may be performed to account for the pressure traverse in the wellbore between layer depths.

Other variations and modifications will be apparent to one of ordinary skill in the art.

Hardware and Software Environment

Figure 1:
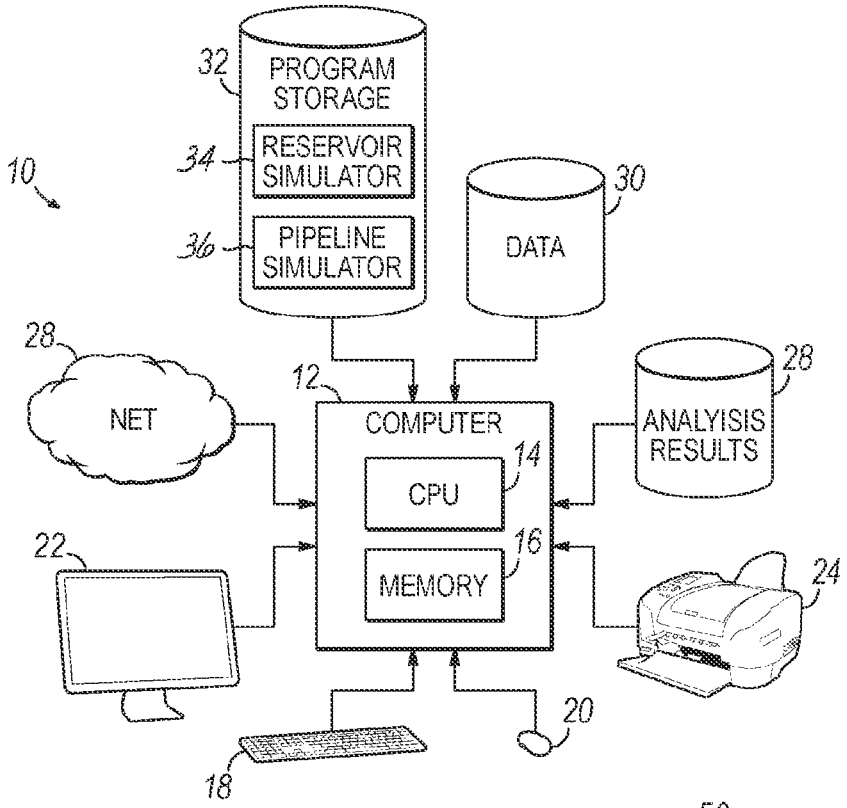
FIG. 1 is a schematic illustration of an exemplary computer system consistent with one embodiment of the present invention.

Turning now to the drawings, wherein like numbers denote like parts throughout the several views, FIG. 1 illustrates a computer system 10 into which implementations of various technologies described herein may be implemented. Computer system 10 may include one or more computers 12, which may be implemented as any conventional personal computer or server. However, those skilled in the art will appreciate that implementations of various techniques described herein may be practiced in other computer system configurations, including hypertext transfer protocol (HTTP) servers, hand-held devices, multiprocessor systems, microprocessor-based or programmable consumer electronics, network PCs, minicomputers, mainframe computers, and the like. In addition, the functionality of computers 12 may be combined in some embodiments, or may be distributed among multiple such computers in a clustered or other distributed architecture.

Computer 12 typically includes a central processing unit 14 including at least one hardware-based microprocessor coupled to a memory 16, which may represent the random access memory (RAM) devices comprising the main storage of computer 10, as well as any supplemental levels of memory, e.g., cache memories, non-volatile or backup memories (e.g., programmable or flash memories), read-only memories, etc. In addition, memory 16 may be considered to include memory storage physically located elsewhere in computer 12, e.g., any cache memory in a microprocessor, as well as any storage capacity used as a virtual memory, e.g., as stored on a mass storage device or on another computer coupled to computer 12. Computer 12 also typically receives a number of inputs and outputs for communicating information externally. For interface with a user or operator, computer 12 typically includes a user interface incorporating one or more user input devices, e.g., a keyboard 18, a pointing device 20, a display 22, a printer 24, etc. Otherwise, user input may be received via another computer or terminal, e.g., over a network interface coupled to a network 26.

Computer 12 may be in communication with one or more mass storage devices, e.g., mass storage devices 28, 30 and 32, which may be external hard disk storage devices. Mass storage devices 28, 30, and 32 are implemented in the illustrated embodiment as hard disk drives, and as such, may be accessed by way of a local area network, wide area network, public network (e.g., the Internet), or other form of remote access. Of course, while mass storage devices 28, 30 and 32 are illustrated as separate devices, a single mass storage device may be used to store any and all of the program instructions, measurement data and results as desired. In addition, in some implementations one or more mass storage devices may be internally disposed within computer 12.

Computer 12 typically operates under the control of an operating system and executes or otherwise relies upon various computer software applications, components, programs, objects, modules, data structures, etc., as will be described in greater detail below. Moreover, various applications, components, programs, objects, modules, etc. may also execute on one or more processors in another computer coupled to computer 12 via a network, e.g., in a distributed or client-server computing environment, whereby the processing required to implement the functions of a computer program may be allocated to multiple computers over a network.

For example, in one implementation, exploration and production data may be stored in mass storage device 30. Computer 12 may retrieve the appropriate data from mass storage device 30 according to program instructions that correspond to implementations of various techniques described herein, and that are stored in a computer readable medium, such as program mass storage device 32. Among the program instructions, for example, may be program instructions used to implement an analytical reservoir simulator 34 and a pipeline simulator 36, which are used for performing inflow and outflow simulation in connection with time-lapse nodal analysis of a transient production system in a manner consistent with the invention.

In general, the routines executed to implement the embodiments of the invention, whether implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning computers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by computer 12. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

In one implementation, computer 12 may present output primarily onto graphics display 22, or alternatively via printer 24. Computer 12 may store the results of the methods described above on mass storage device 28, for later use and further analysis. Keyboard 18 and pointing device (e.g., a mouse, a touchpad, a trackball or the like) 20 may be provided with computer 12 to enable interactive operation.

Computer 12 may be located at a data center remote from where data may be stored. Computer 12 may be in communication with various databases having different types of data. These types of data, after conventional formatting and other initial processing, may be stored by computer 12 as digital data in mass storage device 30 for subsequent retrieval and processing in the manner described above. In one implementation, this data may be sent to computer 12 directly from the databases. In another implementation, computer 12 may process data already stored in mass storage device 30. When processing data stored in mass storage device 30, computer 12 may be described as part of a remote data processing center. Computer 12 may be configured to process data as part of the in-field data processing system, the remote data processing system or a combination thereof. While FIG. 1 illustrates mass storage device 30 as directly connected to computer 12, it is also contemplated that mass storage device 30 may be accessible through a local area network or by remote access. Furthermore, while mass storage devices 28, 30 are illustrated as separate devices for storing input data and analysis results, mass storage devices 28, 30 may be implemented within a single disk drive (either together with or separately from program mass storage device 32), or in any other conventional manner as will be fully understood by one of skill in the art having reference to this specification.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

Those skilled in the art will recognize that the exemplary environment illustrated in FIG. 1 is not intended to limit the present invention. Indeed, those skilled in the art will recognize that other alternative hardware and/or software environments may be used without departing from the scope of the invention.

Time-Lapse Nodal Analysis of a Transient Production System

Figure 2:
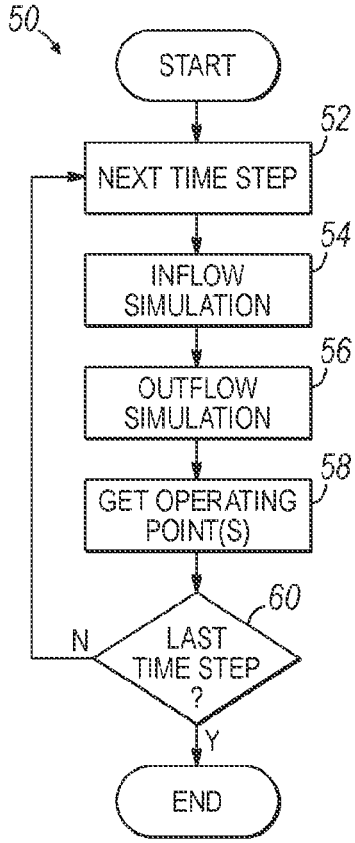
FIG. 2 is a flowchart of an exemplary workflow routine capable of being executed by a nodal analysis tool in the computer system of FIG. 1.

Turning to FIG. 2, an exemplary routine 50 for implementing time-lapse nodal analysis of a transient production system in computer system 10 is illustrated. Time-lapse nodal analysis may be done through time-stepping. For each time step (block 52), routine 50 performs inflow simulation (block 54) and outflow simulation (block 56). From these simulations, operating points are determined based upon the intersection of the inflow curve with the outflow curve (block 58), which is typically the solution of rate and bottom-hole pressure (BHP) given the wellhead pressure (WHP). Thereafter, a determination is made as to whether the last time step has been reached (block 60), and until the last time step is reached, control returns to block 52 to process the next time step. Once the last time step is reached, block 60 terminates routine 50, and analysis is complete.

As will become more apparent below, performing inflow simulation for a node at a given time step typically includes performing reservoir simulation using a computer-implemented analytical reservoir simulator to determine a plurality of points for an inflow curve associated with the node, while performing outflow simulation includes performing pipeline simulation using a computer-implemented pipeline simulator to determine a plurality of points for an outflow curve associated with the node. The determination of the operating point for the time step, e.g., the rate and BHP given the WHP, typically includes determining the operating point based upon the first and second pluralities of points, e.g., as the intersection of the inflow and outflow curves.

Routine 50 may be used in both single-well and multi-well nodal analysis, as well as with multi-layer analysis. Each of these variations is discussed in greater detail below.

Single-Well Nodal Analysis

Single-well analysis consistent with the invention typically does not refer to a production system with only one well, but instead refers to a system in which a solution is sought for a single well while neighbouring well production is known a priori.

Figure 3:
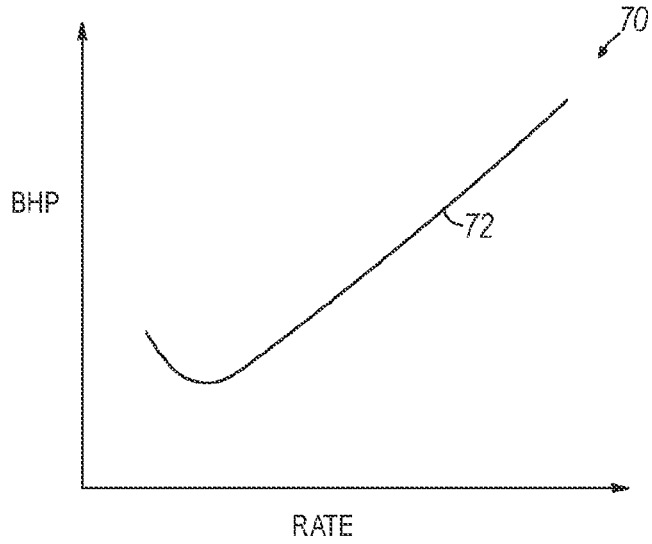
FIG. 3 is a graph of an exemplary outflow curve generated by the workflow routine of FIG. 2 when performing single-well nodal analysis.

With single-well analysis, outflow simulation (block 56 of FIG. 2) may be performed using a pipeline simulator, in a manner well known in the art. While other pipeline simulators may be used in the alternative, one pipeline simulator suitable for use in the illustrated embodiment is the PIPESIM analysis software available from Schlumberger. For a given well-head pressure (WHP), a pipeline simulator may provide a relationship between production rate q and bottom-hole pressure (BHP) $p_{wf}$, which is commonly referred to as an outflow curve, as shown at 72 in graph 70 of FIG. 3. Or in a mathematical form:

$$p_{wf}=h^{(n)}(q) \tag{1}$$

where $h^{(n)}$ represents the outflow curve at n-th time step.

For inflow simulation in single-well analysis (block 54 of FIG. 2), inflow performance, and in particular, an IPR curve, may be obtained by running an analytical reservoir simulator, instead of using IPR models as is typically used. An analytical reservoir simulator is typically implemented as a computer model that predicts the flow of fluids (typically, oil, water, and gas) through porous media. An analytical reservoir simulator typically provides the flexibility of modelling the transient behaviour of real reservoir/well configurations, which may provide an ability to realistically simulate the complete production system, based in part on historical production rates, or history rates. While other analytical reservoir simulators may be used in the alternative, one analytical reservoir simulator suitable for use in the illustrated embodiment is the Gas Reservoir Evaluation and Assessment Tool (GREAT) available from Schlumberger, and described, for example, in U.S. PG Pub. No. 2006/0069511, the disclosure of which is incorporated by reference herein.

An analytical reservoir simulator used in the illustrated embodiment typically allows for multiwall, multi-rate, multilayer inflow performance curves to be generated for any point in time. Moreover, an analytical reservoir simulator is desirably capable of handling the superposition effect of other wells and effect of layers during nodal analysis, as discussed in greater detail below.

Figure 4:
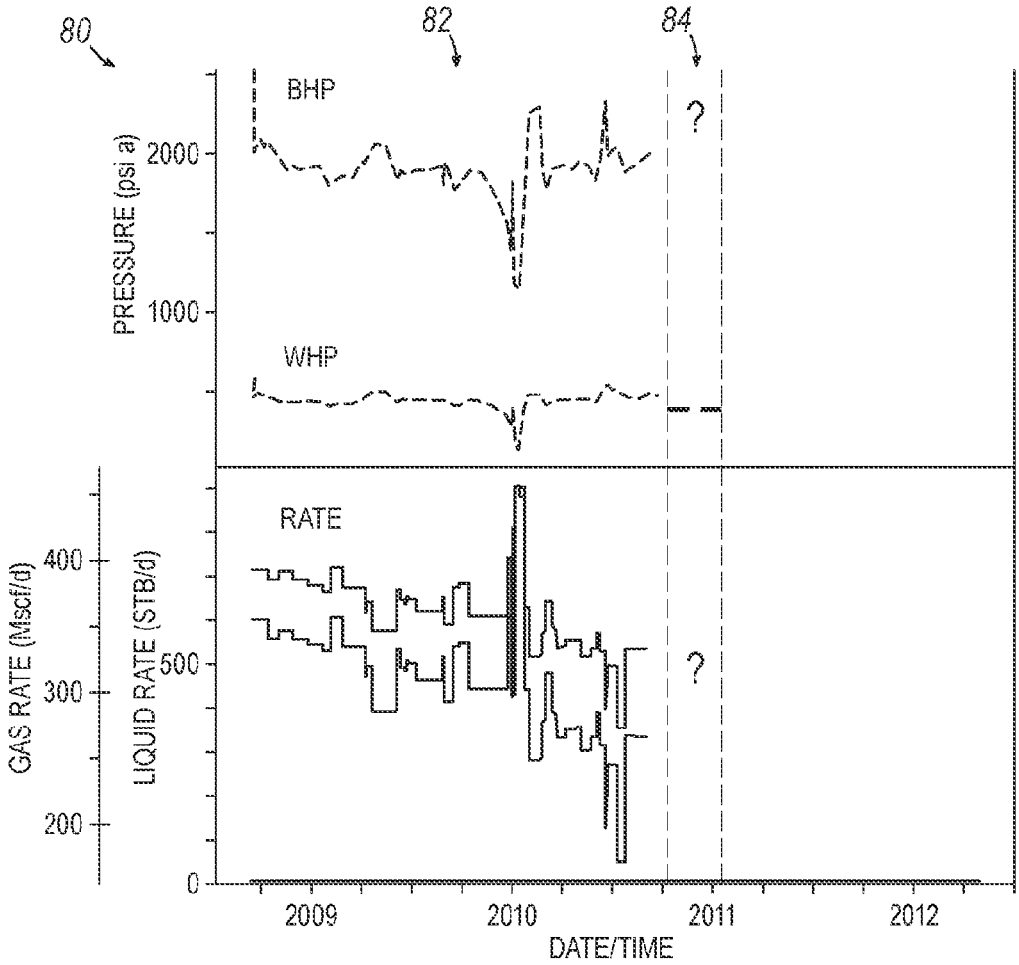
FIG. 4 is a graph of an exemplary inflow curve for a time step generated by the workflow routine of FIG. 2 when performing single-well nodal analysis.

For a system, such as shown in graph 80 in FIG. 4, with two years' production history before (see 82), the objective of inflow simulation is to obtain the relationship between BHP and rate, for a current time step 84. Determining the relationship may be performed using one or more of the following:

Run simulation from the start of production, using the history rates and an assumed rate for current time step. Try different rates with multiple simulations, each giving a BHP, such that a plurality of reservoir simulations are performed from a start of production using historical production rates and a different assumed rate for the current time step for each simulation.

Figure 5:
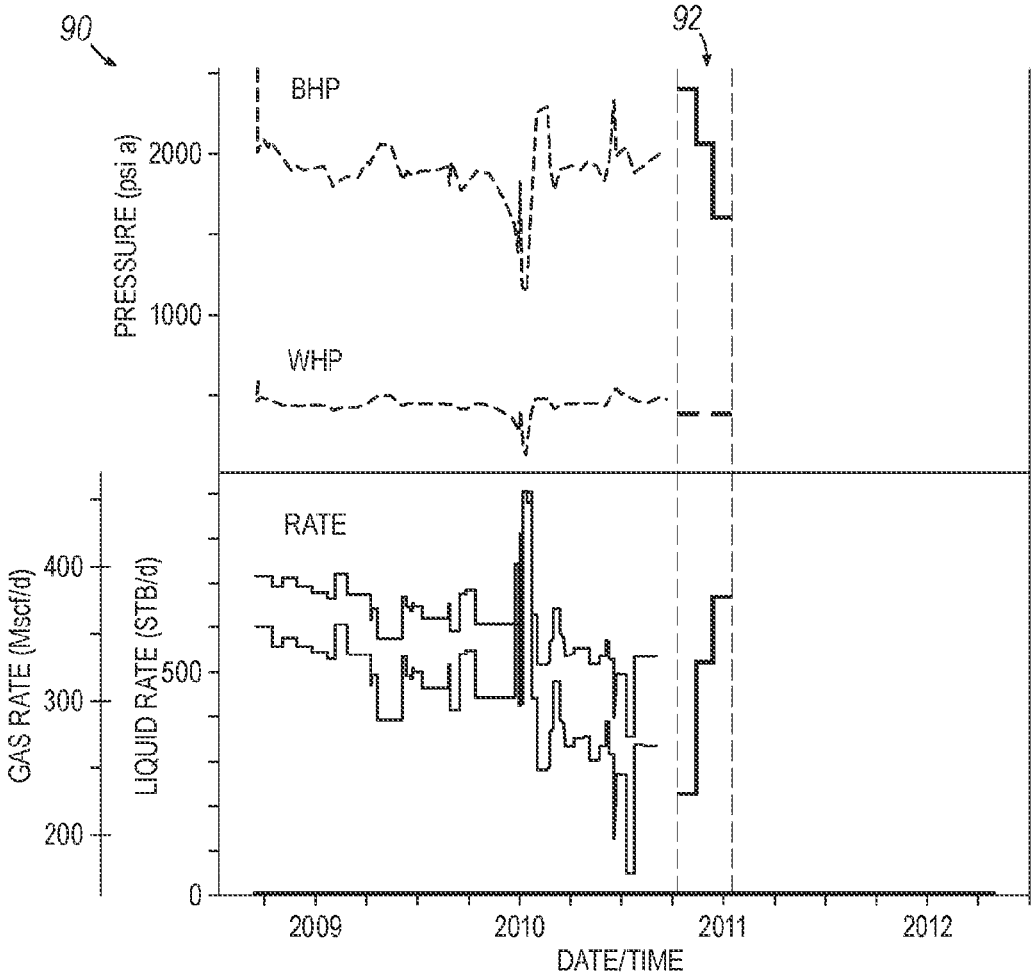
FIG. 5 is a graph of an exemplary multi-rate test capable of being used when generating an inflow curve for a time step using the workflow routine of FIG. 2 when performing single-well nodal analysis.

Run a single simulation from the start of production, using the history rates and a sequence of multiple rates, or called sampling rates, of equal duration, for the current time step, as is shown at 92 in graph 90 of FIG. 5.

Figure 6:
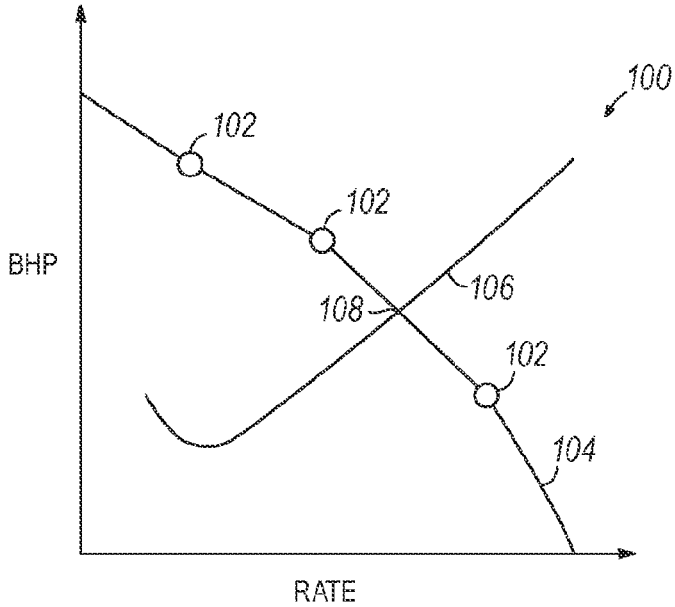
FIG. 6 is a graph of an exemplary inflow curve and outflow curve generated by the workflow routine of FIG. 2 when performing single-well nodal analysis.

The rates and their BHP responses, from either of the two approaches above, if represented on a rate vs. BHP plot, may be represented by different dots, e.g., as shown at 102 in graph 100 of FIG. 6. Connecting the multiple dots gives the inflow curve 104. Or in a mathematical form:

$$p_{wf}=g^{(n)}(q) \tag{2}$$

where $g^{(n)}$ represents the inflow curve at n-th time step. Besides the direct connection, more advanced techniques can be used to process the rate/BHP data. For example, the interference effect of the rate sequence may be considered. Although both methods described above are applicable to embodiments of the present invention, the multi-rate approach is described further in this disclosure.

While running the simulation, all neighbouring well production, if known, may be taken into account and may have an impact on the inflow performance.

The intersection 108 of inflow curve 104 and an outflow curve 106 calculated via outflow simulation in the manner described above provides a solution of rate and bottom-hole pressure at current time step, $p_{wf}^{(n)}$ and $q^{(n)}$, which may conclude the computation of this step:

$$\begin{cases} p_{wf} = h^{(n)}(q) \\ p_{wf} = g^{(n)}(q) \end{cases} \Rightarrow \begin{cases} p_{wf}^{(n)} \\ q^{(n)} \end{cases} \tag{3}$$

Figure 7:
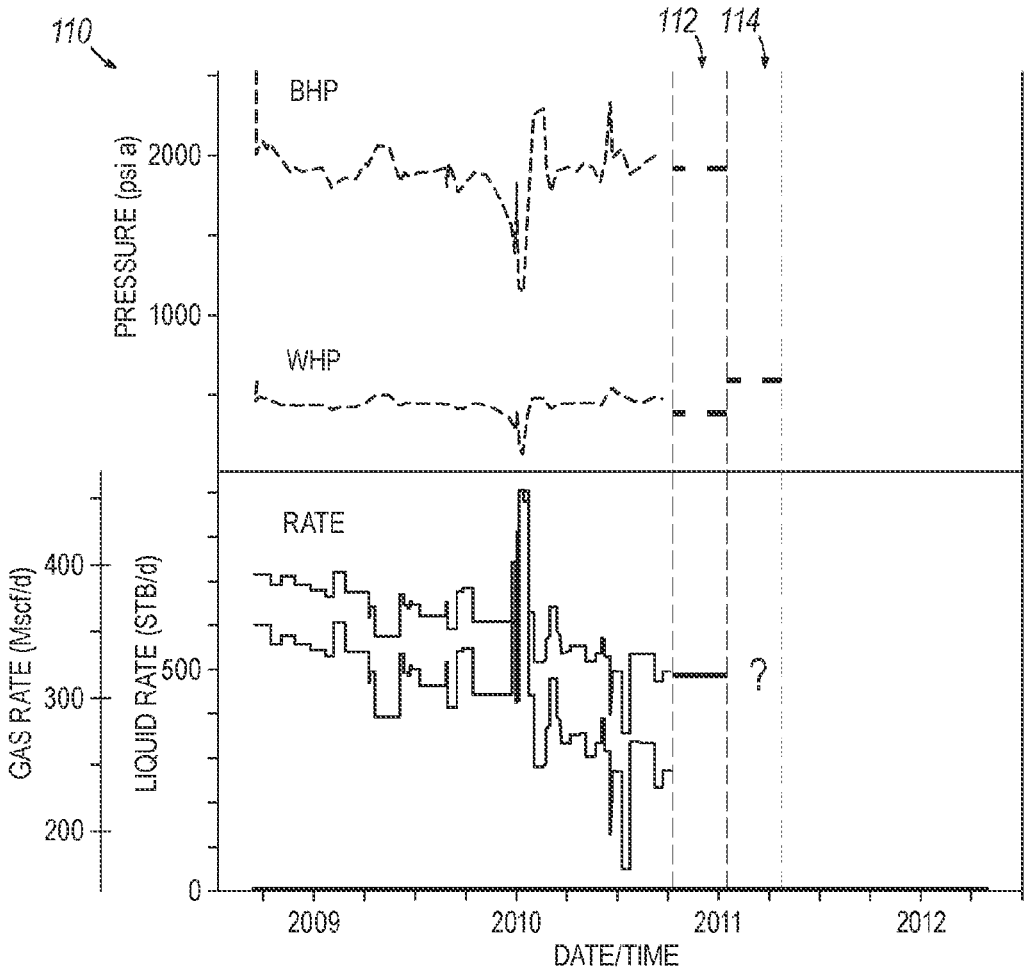
FIG. 7 is a graph of a result of performing nodal analysis for a time step when performing single-well nodal analysis using the workflow routine of FIG. 2.

Simulation may then move on to next time step, as shown in graph 110 of FIG. 7, where the prior time step 112 (corresponding to time step 84 of FIG. 4) is now solved, and the next time step 114 is ready to be processed. The whole process may repeat until arriving at the final time step.

Figure 8A:
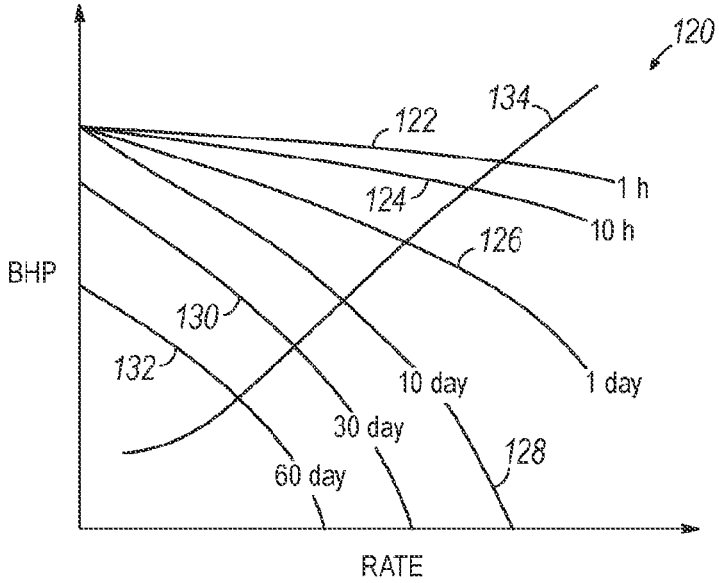
FIGS. 8A and 8B are graphs of exemplary time-lapse nodal analysis results generated by the workflow routine of FIG. 2 when performing single-well nodal analysis.
Figure 8B:
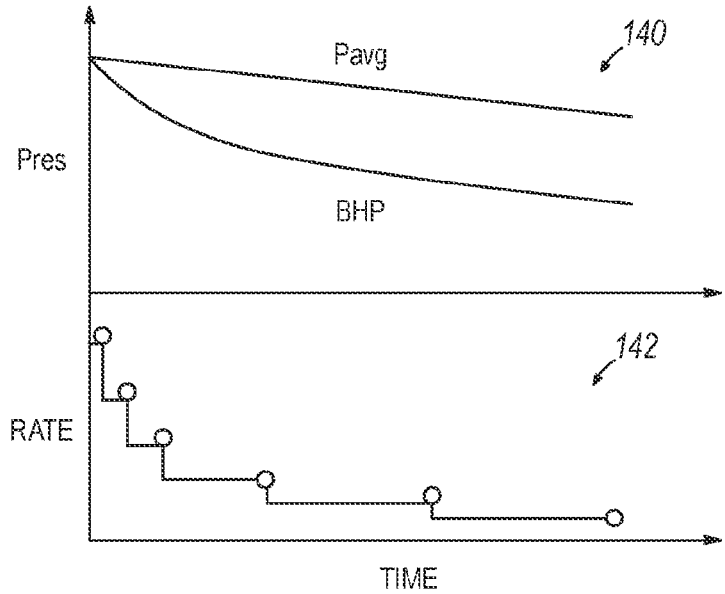

The time-lapse nodal analysis may provide a solution at requested time steps, which may then show the evolution of production. For example, in graph 120 of FIG. 8A, early time and late time IPR curves 122, 124, 126, 128, 130 and 132, respectively for 1 hour, 10 hours, 1 day, 10 days, 30 days and 60 days, obtained from the analytical reservoir simulator, together with the assumed uniform outflow curve 134 throughout the time period, may yield the production rate and BHP at the six time steps, as shown in graphs 140, 142 of FIG. 8B.

Multi-Well Nodal Analysis

The workflow described above applies to single-well nodal analysis, and can be naturally extended to multi-well nodal analysis, that is, to calculate rate and BHP for all wells given their WHPs. Such analysis may be used to determine, for example, with two wells producing at the same time, what their individual rates and BHP's will be given their WHP over the next two years.

In one embodiment consistent with the invention, the procedure described above for single well nodal analysis may be applied to multi-well nodal analysis so that simulation is performed on multiple wells concurrently. Suppose there are $N_w$ wells, then with respect to outflow simulation, outflow may be computed on a well-by-well basis. Therefore it may be the same as single well case. For the j-th well, an outflow curve may be obtained in the manner shown below in equation (4):

$$p_{wf,j}-h_j^{(n)}(q_j)=0 \tag{4}$$

Figure 9A:
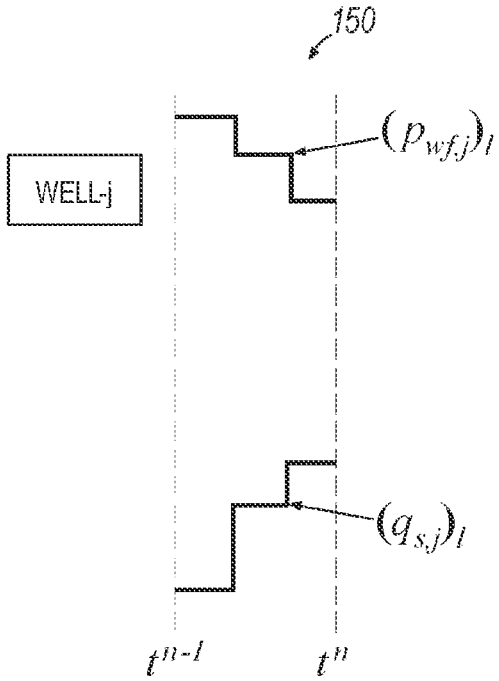
FIGS. 9A and 9B are graphs of an exemplary multi-rate design for multiple wells used by the workflow routine of FIG. 2 when performing multi-well nodal analysis.
Figure 9B:
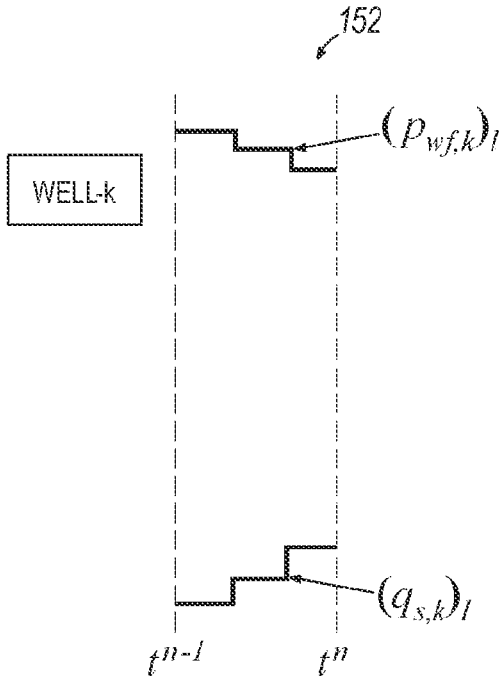

On the other hand, for inflow simulation, multi-rate simulation may be run on all the analyzed wells, with the results, such as those shown in graphs 150, 152 of FIGS. 9A and 9B, may be calculated as shown below in connection with equation (5):

$$(q_{s,j})_l,(p^*_{wf,j})_l, l=1 \ldots m, j=1 \ldots N_w \tag{5}$$

where $(q_{s,j})_l$ is the l-th of the m sampling rates for well j, $(p^*_{wf,j})_l$ is the BHP response corresponding to the l-th sampling rate.

For single-well nodal analysis, the neighbouring well production rates are known a priori and their influence on the analyzed well BHP is taken into account by the simulator automatically. By connecting the results from multi-rate simulation, the actual inflow performance for the well may be determined. For multi-well nodal analysis, however, the simulation response of j-th well above may be the results of other analyzed wells produced at the sampling rates instead of real rates.

Figure 12:
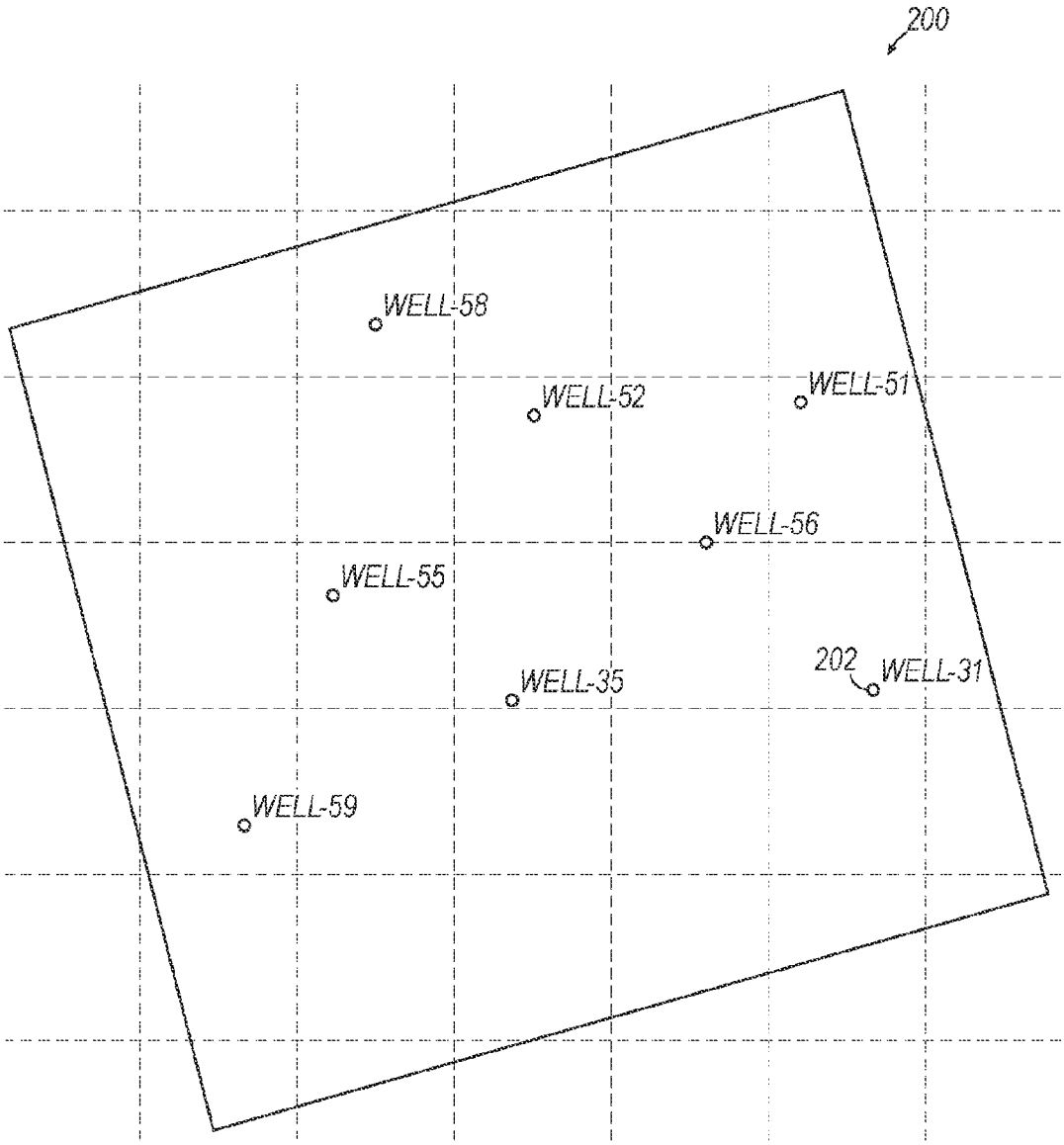
FIG. 12 is a functional view of an exemplary multi-well reservoir consistent with one embodiment of the present invention.
Figure 13:
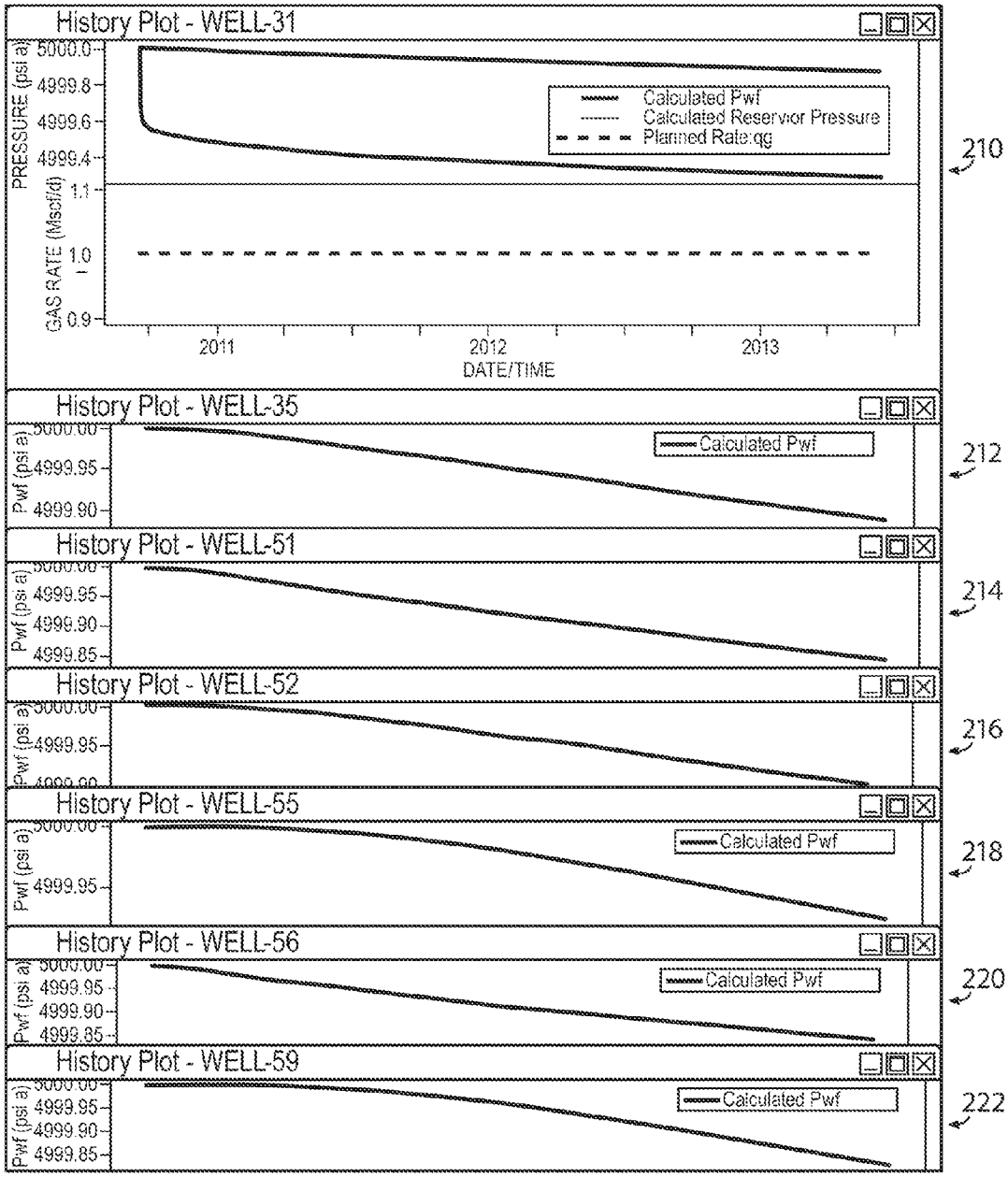
FIG. 13 illustrates graphs of exemplary interference functions generated by a reservoir simulation performed by the workflow routine of FIG. 2 when performing multi-well nodal analysis.

By subtracting the interference effect on one well from the other analyzed wells, the well behaviour at this time step is decoupled from the rates of other wells at the same time step (prior time production rates, however, are taken into account by the simulator), as shown in equation (6) below:

$$(p_{wf,j})_l = (p^*_{wf,j})_l - \sum_{k=1,k\neq j}^{N_w} (q_{s,j})_l f_{jk}^{(n)}, \quad l = 1 \ldots m \tag{6}$$

where $f_{jk}^{(n)}$ is the interference function between well j and well k at n-th time step. Generally, this function may be in the form of an exponential integral, or may be evaluated directly from the simulator, in a manner that will be discussed in greater detail below with reference to FIGS. 12-13.

Figure 10A:
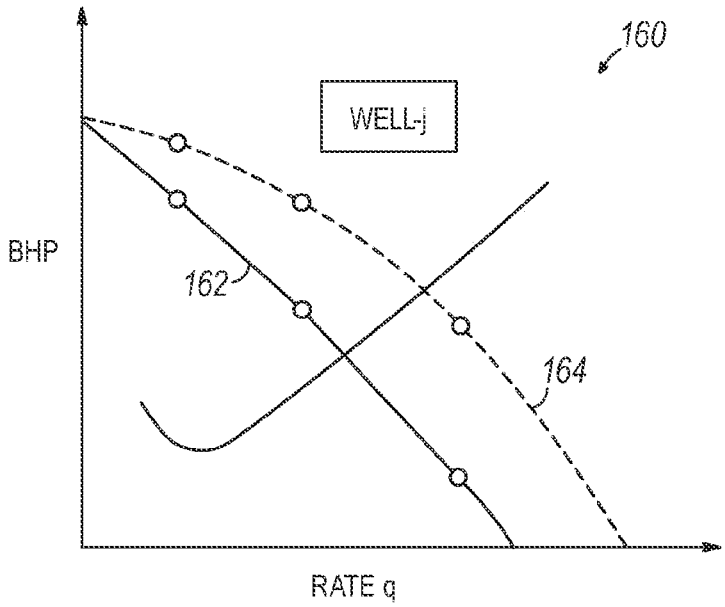
FIGS. 10A and 10B are graphs of exemplary decouple interference used by the workflow routine of FIG. 2 when performing multi-well nodal analysis.
Figure 10B:
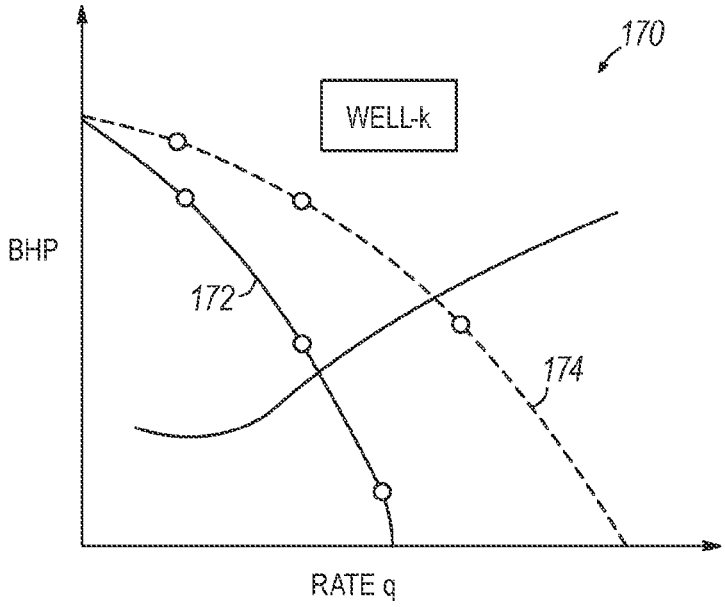

By doing so, the inflow curve may be shifted upwards, free of the influence of other current time step rates. FIGS. 10A and 10B, for example, illustrate graphs 160, 170 for two illustrative wells j and k, where the solid inflow curves 162, 172 are shifted upwards to the dashed inflow curves 164, 174. In the context of the present invention these inflow curves may be referred to as 'clean' curves, defined in equation (7) below:

$$p_{wf,j} = g^{(n)}(q_j) \tag{7}$$

With the clean curve, if real rates from other wells, $q_k$, $k=1 \ldots N_w$, $k\neq j$, are known, the inflow performance curve for j-th well under the interference can be calculated as shown in equation (8) below:

$$p_{wf,j} - g_j^{(n)}(q_j) + \sum_{k=1,k\neq j}^{N_w} q_k f_{jk}^{(n)} = 0 \tag{8}$$

Combined with the outflow curve, the actual rate of well j may be solved, as shown in equation (9) below:

$$\begin{cases} p_{wf,j} = h_j^{(n)}(q_j) = 0 \\ p_{wf,j} - g_j^{(n)}(q_j) + \sum_{k=1,k\neq j}^{N_w} q_k f_{jk}^{(n)} = 0 \end{cases} \tag{9}$$

Figure 11A:
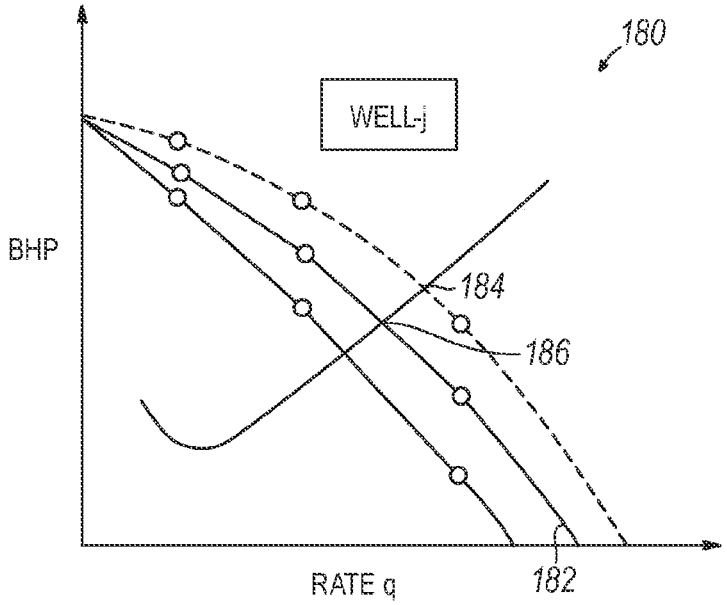
FIGS. 11A and 11B are graphs of exemplary multi-well nodal analysis results generated by the workflow routine of FIG. 2 when performing multi-well nodal analysis.

Such equations can be established for all the analyzed wells and they altogether may describe the whole system. Solution of the $2N_w$ equations may then give the results of multi-well nodal analysis. As shown in graphs 180 and 190 of FIGS. 11A and 11B, the actual inflow curves may be the curves 182 and 192.

Should $h_j^{(n)}$ and $g_j^{(n)}$ be linear, the system may be a linear set of equations, and can be solved all at once. Considering the non-linearity of the two curves, on the other hand, Newton's method may be used. The intersection of outflow curve with the clean inflow curve can be the starting point, as shown at 184 (FIG. 11A) and 194 (FIG. 11B).

Figure 11B:
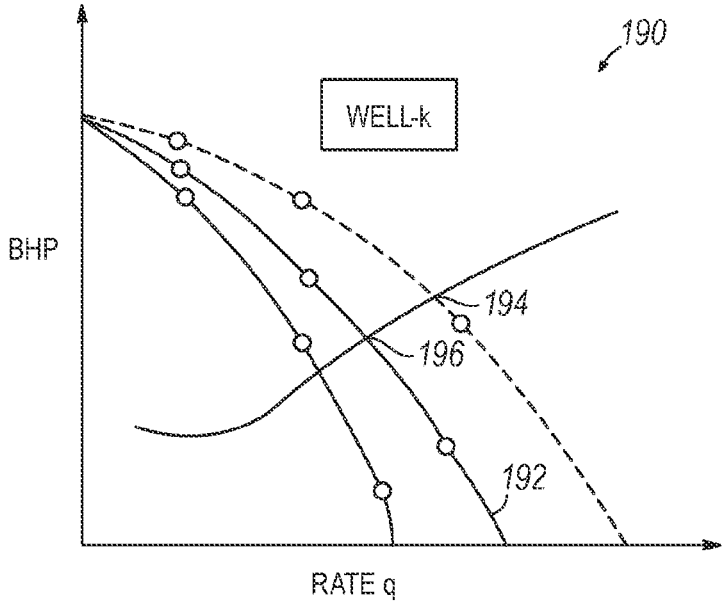

With the rates for all the wells at time step n being solved, the process can move on then to the next time step, until reaching the end, and the final result illustrated at 186 (FIG. 11A) and 196 (FIG. 11B).

It is worth mentioning that although the invention is described in the context that all wells share the same set of time steps, in other embodiments, different time steps may be used for different wells.

As noted above, an interference function may be utilized in some embodiments to describe the pressure response of one well incurred by the unit production from another well.

The functions shown in equations (6), (8) and (9) above, by assuming a homogeneous reservoir, may take the form of equation (10) below:

$$f_{jk}^{(n)} = \frac{70.6\mu}{kh} \int_0^{t_{n-t_{n-1}}} \frac{1}{\tau} \exp\left(-\frac{|r_k - r_j|^2}{4\eta\tau}\right) d\tau \tag{10}$$

where k is formation permeability in mD, h is formation thickness in ft, μ is fluid viscosity in cp, $r_j$, $r_k$ is the location of well j and k, $\eta=0.000264\,k/(\phi\mu c_t)$ with the porosity, $c_t$ the total compressibility in 1/psi.

Or more accurately, the interference function can be evaluated from reservoir simulation directly. The wells may be put on unit production one by one, while all the other analyzed wells may be shutdown and their pressure response observed. For example, in the multi-well case illustrated at 200 in FIG. 12, well-31, at 202, is put on unit production, and the other six wells are shut down and their pressure is recorded, as illustrated by graphs 210, 212, 214, 216, 218, 220, and 222 of FIG. 13. The same procedure then moves on to each of the wells to get all the interference functions.

Multi-Layer Nodal Analysis

Figure 14:
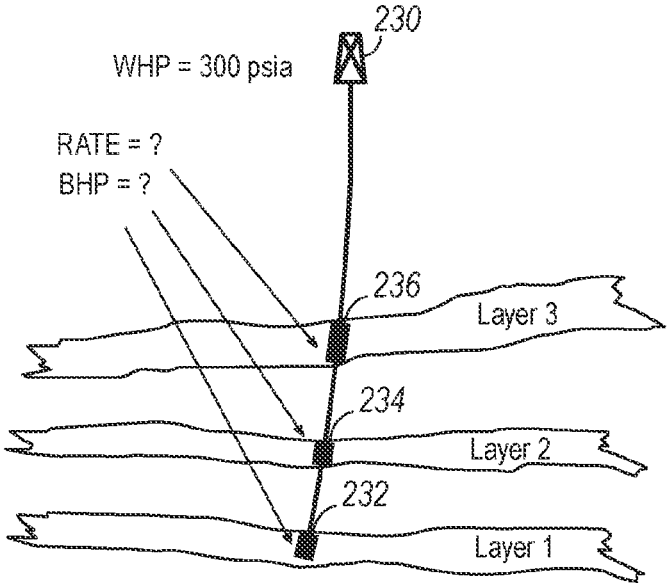
FIG. 14 is a functional view of a multi-layer well producing from multiple layers of a reservoir.

The aforementioned techniques may also be applied to multi-layer nodal analysis, e.g., to determine the rate from and BHP at each layer of a well producing at the same time from three layers, given a WHP, and considering the pressure loss in the wellbore between layers. FIG. 14, for example, illustrates a well 230 producing from three layers 232, 234 and 236.

Suppose there are $N_L$ layers. The rate from each layer, the wellbore pressure at the mid-perforation of each layer, are $q_i$, $p_{wf,i}$, $i=1 \ldots N_L$. The index i increases upwards from the deepest layer.

To perform outflow simulation, the simulation is performed section by section for the wellbore. For the $N_L$-th layer, that is, the top-most one, the wellbore pressure at its depth is related to wellhead pressure by total production rate:

$$p_{wh} = p_{wf,N_L} - h_{N_L}^{(n)}\left(\sum_{j=1}^{N_L} q_j\right) \tag{11}$$

where $h_{N_L}^{(n)}$ is the outflow performance curve of the wellbore section from the top layer to wellhead, at the n-th time step.

Figure 15:
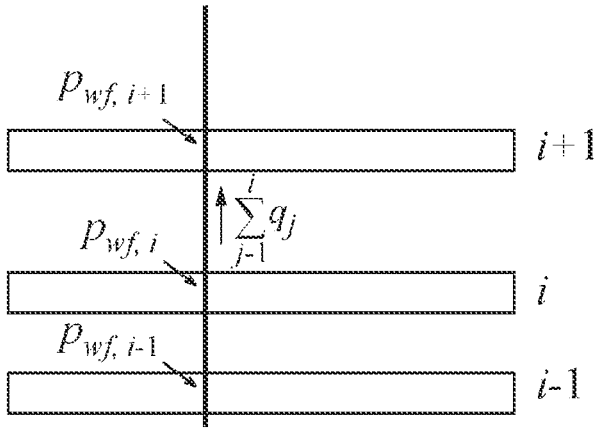
FIG. 15 is a functional view illustrating wellbore pressure loss between layers in the multi-layer well of FIG. 14.

Then from this depth downwards to the next layer, as illustrated in FIG. 15, the wellbore pressure loss between layers is of the form:

$$p_{wf,i+1} = p_{wf,i} - h_i^{(n)}\left(\sum_{j=1}^{i} q_j\right), \quad i = 1 \ldots N_L - 1 \tag{12}$$

where $h_i^{(n)}$ is the performance curve of the wellbore section from the layer i to layer i+1.

Unifying equations (11) and (12) into one equation results in equation (13), as follows:

$$p_{wf,i+1} = p_{wf,i} - h_i^{(n)}\left(\sum_{j=1}^{i} q_j\right), \quad i = 1 \ldots N_L \tag{13}$$

where the notation $p_{wf,N_L+1}=p_{wh}$.

To perform inflow simulation, for each of the layers, its inflow performance curve may be obtained through simulation, as described above for single-well nodal analysis, and it takes the form:

$$p_{wf,i}=g_i^{(n)}(q_i), i=1 \ldots N_L \tag{14}$$

Combining outflow and inflow equations together, the resulting equations (15) are as follows:

$$\begin{cases} p_{wf,i+1} = p_{wf,i} - h_i^{(n)}\left(\sum_{j=1}^{i} q_j\right) \\ p_{wf,i} = g^{(i)}(q_i) \end{cases} \tag{15}$$

Equations (15) describe the whole production system consisting of the $N_L$ layers. Solution of the $2N_L$ equations then gives the results of multi-layer nodal analysis.

Should $h_i^{(n)}$ and $g_i^{(n)}$ be linear, the system is a linear set of equations and can be solved all at once. Considering the non-linearity of the two curves, on the other hand, other solution techniques like Newton's method may be used in the alternative. And with the rates for all the layers at time step n being solved, the process can move on then to the next time step, until reaching the end.

Time-lapse nodal analysis as described herein may be utilized in a number of applications related to a transient petroleum production system consistent with the invention. For example, for a shale gas well with multi-stage transverse fractures, time-lapse nodal analysis may be used to model the multi-phase fluid flow from a reservoir to the fractures, into the wellbore and all the way up to the wellhead, enabling a prediction to be made as to the transient production of the well (e.g., over the next twenty years), given a specified pressure control at the well head. As another example, should an offshore well blow out, time-lapse nodal analysis may be used to model the transient fluid flow from the multi-layered reservoir to the sea floor, such that a prediction may be made of spill rate over a particular period of time (e.g., over the next twelve months).

While the foregoing is directed to implementations of various technologies described herein, other and further implementations may be devised without departing from the basic scope thereof, which may be determined by the claims that follow. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method of performing nodal analysis for a multi-well petroleum production system comprising a plurality of wells coupled to a reservoir, the method comprising:

for a node in the multi-well petroleum production system:

simulating inflow for the node by performing reservoir simulation using a computer-implemented analytical reservoir simulator that predicts a flow of fluid through a porous media, wherein the reservoir simulation performed by the analytical reservoir simulator simulates inflow by simulating a transient behavior of the multi-well petroleum production system based at least in part on a production history for the multi-well petroleum production system; and determining an operating point for the node based upon the reservoir simulation.

2. The method of claim 1, wherein performing reservoir simulation includes determining a first plurality of points for an inflow curve associated with the node, wherein the method further comprises determining a second plurality of points for an outflow curve associated with the node, and wherein determining the operating point for the node includes determining the operating point based upon the first and second pluralities of points.

3. The method of claim 2, wherein determining the operating point for the node includes determining the operating point as a point of intersection between the inflow curve and the outflow curve.

4. The method of claim 2, wherein determining the second plurality of points includes performing pipeline simulation using a computer-implemented pipeline simulator to determine the second plurality of points.

5. The method of claim 2, wherein performing reservoir simulation, determining the second plurality of points, and determining the operating point are performed for a first time step among a plurality of time steps, the method further comprising performing time-lapse nodal analysis for the node by performing reservoir simulation, determining an outflow curve, and determining an operating point for the node for each of the plurality of time steps.

6. The method of claim 5, wherein performing time-lapse nodal analysis for the node includes determining a transient behavior of the multi-well petroleum production system over the plurality of time steps.

7. The method of claim 6, wherein performing reservoir simulation comprises performing a plurality of reservoir simulations from a start of production using historical production rates, wherein each of the plurality of reservoir simulations uses a different assumed rate for the first time step.

8. The method of claim 6, wherein performing reservoir simulation comprises performing a single reservoir simulation from a start of production using historical production rates for the reservoir and a sequence of sampling rates for the first time step.

9. The method of claim 5, wherein the node is associated with a single well among a plurality of wells in the multi-well petroleum production system, and wherein performing reservoir simulation includes taking into account production of other wells in the multi-well petroleum production system during the reservoir simulation.

10. The method of claim 5, wherein the node is associated with a single well among a plurality of wells in the multi-well petroleum production, and wherein performing reservoir simulation comprises concurrently performing multi-rate simulation on the plurality of wells.

11. The method of claim 10, wherein concurrently performing multi-rate simulation of the plurality of wells includes, for each of the plurality of wells, subtracting an interference effect from other wells among the plurality of wells.

12. The method of claim 11, wherein subtracting the interference effect includes generating a plurality of clean inflow curves, the method further comprising generating a plurality of actual rates for the plurality of wells using the clean inflow curves and outflow curves associated with each of the plurality of wells, using the plurality of actual rates to establish a plurality of equations for the plurality of wells, and solving the plurality of equations using Newton's method.

13. The method of claim 1, further comprising performing multi-layer nodal analysis by performing outflow simulation for each of a plurality of sections for a wellbore associated with a well in the multi-well petroleum production system to determine wellbore pressure loss for each of a plurality of layers, generating a plurality of equations representing inflow and outflow at each of the plurality of layers, and solving the plurality of equations.

14. The method of claim 1, wherein performing reservoir simulation includes generating an inflow performance relation (IPR) curve for the node.

15. The method of claim 1, wherein the operating point comprises a solution of rate and bottom-hole pressure (BHP) for a given wellhead pressure (WHP).

16. The method of claim 1, wherein the node is associated with a gas well with multi-stage transverse fractures, and wherein the method further comprises performing time-lapse nodal analysis using the analytical reservoir simulator to model multi-phase fluid flow from the reservoir, through the multi-stage transverse fractures, into a wellbore of the gas well and to a wellhead of the gas well and predict a transient production of the gas well over a period of time.

17. The method of claim 1, wherein the node is associated with a blown out offshore well, wherein the reservoir is a multi-layer reservoir, and wherein the method further comprises performing time-lapse nodal analysis using the analytical reservoir simulator to model transient fluid flow from the multi-layer reservoir to a sea floor and predict a spill rate for the blown out well over a period of time.

18. An apparatus, comprising:

a processor; and program code configured upon execution by the processor to perform nodal analysis for a multi-well petroleum production system comprising a plurality of wells coupled to a reservoir, wherein the program code is configured to, for a node in the multi-well petroleum production system, simulate inflow for the node by performing reservoir simulation using an analytical reservoir simulator that predicts a flow of fluid through a porous media, and determine an operating point for the node based upon the reservoir simulation, wherein the reservoir simulation performed by the analytical reservoir simulator simulates inflow by simulating a transient behavior of the multi-well petroleum production system based at least in part on production history for the multi-well petroleum production system.

19. The apparatus of claim 18, wherein the program code is configured to perform reservoir simulation by determining a first plurality of points for an inflow curve associated with the node, wherein the program code is configured to perform pipeline simulation using a pipeline simulator to determine a second plurality of points for an outflow curve associated with the node, wherein the program code is configured to determine the operating point for the node based upon the first and second pluralities of points, wherein the program code is configured to perform time-lapse nodal analysis for the node by performing reservoir simulation, performing pipeline simulation and determining an operating point for each of a plurality of time steps.

20. The apparatus of claim 18, wherein the node is associated with a single well among a plurality of wells in the multi-well petroleum production system, and wherein the program code is configured to perform reservoir simulation by concurrently performing multi-rate simulation on the plurality of wells.

21. The apparatus of claim 18, wherein the program code is further configured to perform multi-layer nodal analysis by performing outflow simulation for each of a plurality of sections for a wellbore associated with a well in the multi-well petroleum production system to determine wellbore pressure loss for each of a plurality of layers, generating a plurality of equations representing inflow and outflow at each of the plurality of layers, and solving the plurality of equations.

22. A program product, comprising:

a computer readable storage medium; and program code stored on the computer readable storage medium and configured upon execution to perform nodal analysis for a multi-well petroleum production system comprising a plurality of wells coupled to a reservoir, wherein the program code is configured to, for a node in the multi-well petroleum production system, simulate inflow for the node by performing reservoir simulation using an analytical reservoir simulator that predicts a flow of fluid through a porous media, and determine an operating point for the node based upon the reservoir simulation, wherein the reservoir simulation performed by the analytical reservoir simulator simulates inflow by simulating a transient behavior of the multi-well petroleum production system based at least in part on production history for the multi-well petroleum production system.

* * * * *